US005647431A

United States Patent [19]

Takeshita et al.

[11] Patent Number: 5,647,431

[45] Date of Patent: Jul. 15, 1997

[54] AIR CONDITIONER AND HEAT EXCHANGER USED THEREFOR

[75] Inventors: Michimasa Takeshita; Takayuki Yoshida; Yoshiaki Tanimura; Hitoshi Iijima, all of Shizuoka; Takashi Gotoh; Tsuneo Yumikura, both of Amagasaki, all of Japan

[73] Assignee: Mitsubishi Denki Kabushiki Kaisha, Tokyo, Japan

[21] Appl. No.: 448,307

[22] Filed: May 23, 1995

[30] Foreign Application Priority Data

Mar. 30, 1995 [JP] Japan ..... 7-074097

[51] Int. Cl.[6] ..... F28F 1/22; F28F 1/32; F28F 1/36

[52] U.S. Cl. ..... 165/119; 165/122; 165/171; 165/DIG. 498; 165/DIG. 310

[58] Field of Search ..... 165/150, 151, 165/171, 122, 119

[56] References Cited

U.S. PATENT DOCUMENTS

| | | | |
|---|---|---|---|
| 2,469,635 | 5/1949 | Dalin et al. | 165/171 X |
| 2,620,170 | 12/1952 | Brickman | 165/150 X |
| 4,056,143 | 11/1977 | Martin | 165/176 |

FOREIGN PATENT DOCUMENTS

| | | | |
|---|---|---|---|
| 3309923 | 9/1984 | Germany | 165/171 |
| 5-133691 | 5/1993 | Japan | 165/171 |
| 6331290 | 11/1994 | Japan . | |
| 620292 | 3/1949 | United Kingdom . | |
| 1171230 | 6/1967 | United Kingdom . | |
| 2146111 | 4/1985 | United Kingdom . | |

*Primary Examiner*—Allen J. Flanigan

*Attorney, Agent, or Firm*—Oblon, Spivak, McClelland, Maier & Neustadt, P.C.

[57] ABSTRACT

A heat exchanger mounted on an air condition is constructed such that at least one row of heat conduction pipe groups are arranged across an air passage. Each heat conduction pipe groups is constructed such that a plurality of heat conduction pipes 22 are arranged in parallel with each other and a fine wire 23 made of a metallic material having excellent heat conductivity is spirally wound around each adjacent heat conduction pipes 22. Thus, performances of the heat exchanger can be improved without a possibility that the air conditioner is designed with larger dimensions. In addition, the heat exchanger includes a plurality of heat conduction pipes 39 arranged in the form of at least one row with a constant distance between adjacent ones and a plurality of twisted wires 40. The twisted wires 40 are arranged so as to alternately come in contact with one side and opposite side of each heat conduction pipe 39 extending at a right angle relative to the row direction of each heat conduction pipe 39, and moreover, alternately come in contact with one side and opposite other side of each heat conduction pipe 39 extending in the longitudinal direction. With this construction, high heat conductivity can be realized, and an occurrence of clogging with dew droplets can be prevented while maintaining a heat conduction area.

17 Claims, 17 Drawing Sheets

● : HEAT EXCHANGER OF THE PRESENT INVENTION

○ : CONVENTIONAL HEAT EXCHANGER

AIR CONDITIONER AND HEAT EXCHANGER USED THEREFOR

BACKGROUND THE INVENTION

1. Field of the invention

The present invention relates generally to an air conditioner. More particularly, the present invention relates to the structure of a heat exchanger arranged in the air conditioner.

2. Description of the Related Art

FIG. 25 is a vertical sectional view which shows a conventional air conditioner. Referring to the drawing, a suction grille 2 is formed on the front surface of a housing 1 as an air suction port. An air blow-off port 3 is formed on the lower part of the housing 1. An air passage 4 is formed so as to communicate the suction grille 2 with the air blow-off port 3. A filter 5 is disposed at the rear stage of the suction grille 2 and across the air passage 4. In addition, a heat exchanger 6 is disposed at the rear stage of the filter 5 and across the air passage 4. Further, a blower 7 is arranged at the rear stage of the heat exchanger 6 in the air passage 4, and a drain receiver 8 is disposed below the heat exchanger 6. In the drawing, an arrow mark A shows the flowing of external working fluid, e.g., air. Although not shown, a plurality of vanes are rotatably disposed in the air blow-off port 3 so as to redirect the flow of air.

FIG. 26 is perspective view of a heat exchanger for a conventional air conditioner, and FIG. 27 is a plan view which shows a plate fin for the conventional heat exchanger. The heat exchanger 6 is constructed such that a single heat conduction pipe 9 is turned several times and a large number of plate fins 10 are fixedly held in parallel with each other with a predetermined pitch in the axial direction of the heat conduction pipe 9. A plurality of cut-up pieces 10*a* are formed on each plate fin 10. Here, a copper pipe having a circular sectional shape and a diameter of 6 mm to 12 mm is used for the heat conduction pipe 9, and an aluminum plate is used for the plate fin 10. A working fluid B is caused to flow through the heat conduction pipe 9.

Next, a mode of operation of the conventional air conditioner will be described below.

When the blower 7 is driven, air A in the room is introduced into the housing 1 from the suction grille 2, passes through the air passage 4 and is blown off from the air blow-off port 3 into the room. At this time, when the air A passes through the filter 5 disposed across the air passage 4, dust is removed from the air A. And then, when the air A passes through the heat exchanger 6, heat exchanging is effected between the air A and the working fluid B flowing through the heat conduction pipe 9 to cool or heat the interior of the room.

With the conventional heat exchanger 6, as shown in FIG. 28, an air-temperature boundary layer C is cut, attributable to a front edge effect with the aid of the cut-up pieces 10*a* of the plate fin 10 when the air A passes by it. By cutting the air-temperature boundary layer C, heat conduction performances are elevated, resulting in performances of the air conditioner being improved.

FIG. 29 is a vertical sectional view of another conventional air conditioner, and FIG. 30 is a plan view of a plate fin used for the air conditioner. A plurality of holes 11*a* are formed through the plate fin 11 so as to allow heat conduction pipes 9 to be inserted therethrough, and cutouts 11*b* are formed on the plate fin 10 at plural locations. The plate fin 11 is bent at the cutouts 11*b* so that the heat exchanger 6A exhibits a contour having bent parts. In addition, another suction grille 2 serving as an air suction port is formed also through the upper surface of the housing 1, and a filter 5 and a heat exchanger 6A are arranged in the housing 1 to hinder the flowing of air sucked through the grilles 2 formed through the fore surface and the upper surface of the housing 1.

With the conventional heat exchanger 6A, a heat conduction area is increased attributable to the bent contour to enhance performances of the air conditioner.

To enhance the performances of the conventional air conditioner, the following measure are hitherto taken. Specifically, one of them is to improve heat conduction performances of the heat exchanger. Other one is to increase an area of the heat exchanger. Another one is to reduce an air pressure loss of the heat exchanger to increase a quantity of air passing past the heat exchanger.

With the conventional heat exchanger 6, by cutting the air-temperature boundary layer C attributable to the front edge effect with the aid the cut-up pieces 10*a* formed from the plate fin 10, heat conduction properties are improved to enhance the performances of the heat exchanger. However, formation of the cut-up pieces 10*a* from the plate fin 10 leads to the result that an air pressure loss is increased. Thus, in the case that this heat exchanger is incorporated in the air conditioner, a quantity of air flowing is reduced with the same power consumed by the blower 7. Consequently, there arises a problem that an effect for enhancing the performances of the air conditioner is reduced.

In addition, since the heat exchanger 6 has high rigidity due to the structure of the heat conduction pipes 9 and the plate fin 10 assembled together, the air conditioner has design flexibility. To increase a conduction surface by bending, the cutouts lib should be formed by cutting out a part of the plate fin 11 like the heat exchanger 6A. In this case, there arises other problem that the air conditioner is fabricated at an increased cost. Increasing of the conduction area of the heat exchanger leads to the result that the housing 1 is designed with large dimensions, i.e., the air conditioner is designed with large dimensions. In addition, unless a size of the housing 1 is changed, there is a limit for increasing a heat conduction area.

With the heat exchangers 6 and 6A, the plate fins 10 and 11 are dimensioned to have width of 10 mm or more to increase a heat exchange area. However, widening of the width of the plate fins 10 and 11 leads to the result that the housing 1 is designed with large dimensions. Thus, there arises another problem that the air conditioner is designed with large weight and fabricated at an increased cost.

In addition, with the heat exchangers 6 and 6A, since the structure of the whole heat exchanger is uniformly designed, pressure loss on the air side is equalized at the front surface, an air speed is reduced at the lowermost end part of the heat exchanger as well as at the part including no suction grille, and the air speed is fastened at other part rather than the foregoing ones. Consequently, the heat exchanger is not effectively used, performances of the air conditioner are degraded, and moreover, noise is generated from the air conditioner.

FIG. 31 is a perspective view of a conventional heat exchanger as disclosed on an official gazette of Japanese Patent Laid-Open Publication NO. 61-153388, and FIG. 32 is a sectional view of the heat exchanger shown in FIG. 31. A plurality of heat conduction pipes 12 are arranged in parallel with each other with a predetermined distance between adjacent ones, and a fine wire 13 is arranged between adjacent heat conduction pipes 12 along the surface of these heat conduction pipes 12 so that the fine wire 13 is knitted like Japanese mat on the assumption that each heat convention pipe 12 serves as a warp and the fine wire 13 serves as a welt. In the drawings, reference character A denotes an external working fluid, while reference character B denotes a internal working fluid.

In FIG. 32, the flowing state of the external working fluid A is shown by arrow marks. When the fluid A collides against the fine wire 13, the flowing state of the fluid A is disturbed, and the fluid A located below the fine wire 13 flows in the transverse direction along the fine wire 13 as shown by arrow marks while rising up on the surface of the heat conduction pipe 12. As a result, the time when the fluid A comes in contact with the heat conduction pipe 12 is increased.

In this case, since the fine wire 13 has a very small diameter, it comes in contact with the heat conduction pipe 12 with a small contact area. For this reason, the contact area between the fluid A and the heat conduction pipe 12 is not reduced by the fine wires 13, causing a heat conduction function to be effectively practiced.

In this conventional example, since each fine wire 13 has a circular or elliptical sectional shape, the contact part with the heat conduction pipe 12 exhibits an arc-shaped contour so that point contact or line contact occurs between the fine wire 13 and the heat conduction pipe 12. Thus, a contact area between the fluid A and the surface of each heat conduction pipe 12 is not reduced by the fine wire 13. Thus, a heat exchanger having a high heat exchanging efficiency is obtainable.

However, since this conventional heat exchanger has a small width of 1 to 3 mm, although it has large heat conductivity compared with the heat exchanger including the plate fin 10 around the heat conduction pipe 9 as shown in FIG. 26, since the heat conducting area is small as 1/10 or less, there arises a problem that a necessary quantity of heat exchanging can not be obtained.

In the case that the temperature of the external working fluid (e.g., refrigerant) is lower than a dew temperature of air, moisture in the air becomes dew droplets. At this time, dew droplets are held between the fine wires so that the space between the fine wires 13 is clogged with dew droplets. Since air does not sufficiently past the fine wires 13, a quantity of air flowing is reduced due to pressure loss. Thus, there arises a problem that a necessary quantity of heat exchanging is not obtained.

SUMMARY OF THE INVENTION

The present invention has been made in consideration of the aforementioned problems to be solved.

A first object of the present invention is to provide an air conditioner which assures that high performances can be realized without any possibility that the air conditioner has large dimensions and is fabricated at an increased cost.

A second object of the present invention is to provide a heat exchanger which assures that a heat conduction area per unit area at the front surface of the heat exchanger can be increased, a quantity of heat exchanging is not reduced even when the heat exchanger is used in a wetted state, and a necessary quantity of heat exchanging can be obtained.

In order to achieve the above object, according to one aspect of the present invention, there is provided an air conditioner comprising a housing having an air suction port disposed on at least one of a fore surface and an upper surface, air blow-off port disposed on a lower part and air passage formed so as to communicate the air suction port with the air blow-off port, a filter disposed at the rear stage of the air suction port so as to obstruct the air passage, a heat exchanger arranged at the rear stage of the filter so as to obstruct the air passage and a blower disposed at the rear stage of the heat exchanger in the air passage, wherein the heat exchanger has at least one row of heat conduction pipe groups which are arranged to across the air passage, each heat conduction pipe group comprises a plurality of heat conduction pipes which are arranged in parallel with each other with a predetermined distance between adjacent ones and fine wires each made of a metallic material having excellent heat conductivity which is spirally wound around each pair of heat conduction pipes.

According to another aspect of the present invention, there is provided a heat exchanger comprising a plurality of heat conduction pipes arranged in the form of at least one row with a constant distance between adjacent ones and a plurality of twisted wires each formed by twisting and winding plural fine wires each made of a metallic material having excellent heat conductivity, wherein the twisted wires are knitted so as to alternately come in contact with one side and an opposite other side of each said heat conduction pipe extending at a right angle relative to a row direction of each heat conduction pipe, and moreover, alternately come in contact with one side and opposite other side of each said heat conduction pipe extending a longitudinal direction of the heat conduction pipe.

According to further aspect of the present invention, there is provided a heat exchanger comprising a plurality of heat conduction pipes arranged in the form of two or more rows with a constant distance between adjacent ones and a plurality of twisted wires each formed by twisting and winding plural fine wires each made of a metallic material having excellent heat conductivity, wherein the twisted wires are knitted so as to alternately come in contact with one side and opposite other side of each heat conduction pipe extending in a direction different from the row, and moreover, alternately come in contact with one side and opposite other side of each heat conduction pipe extending in a longitudinal direction of the heat conduction pipe.

DESCRIPTION OF THE PREFERRED EMBODIMENTS

The present invention will now be described below with reference to the accompanying drawings which illustrate preferred embodiments thereof.

Embodiment 1.

Figure 1:
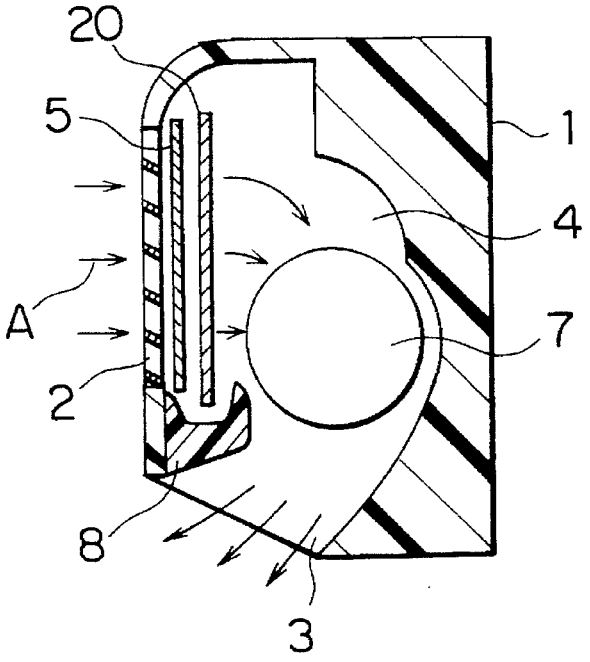
FIG. 1 is a vertical sectional view of an air conditioner constructed in accordance with a first embodiment of the present invention.
Figure 2:
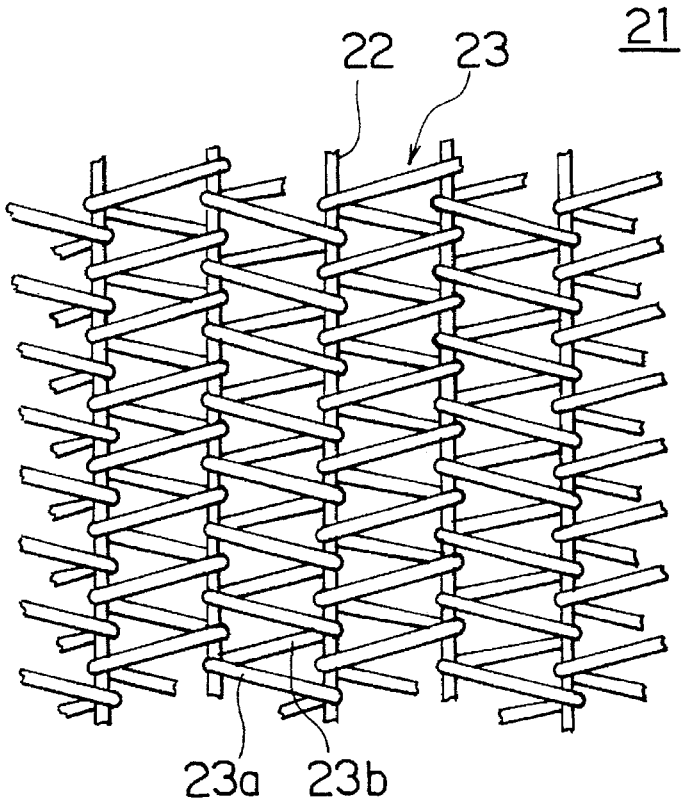
FIG. 2 is a plan view which shows essential components constituting a heat exchanger for the air conditioner constructed in accordance with the first embodiment of the present invention.
Figure 25:
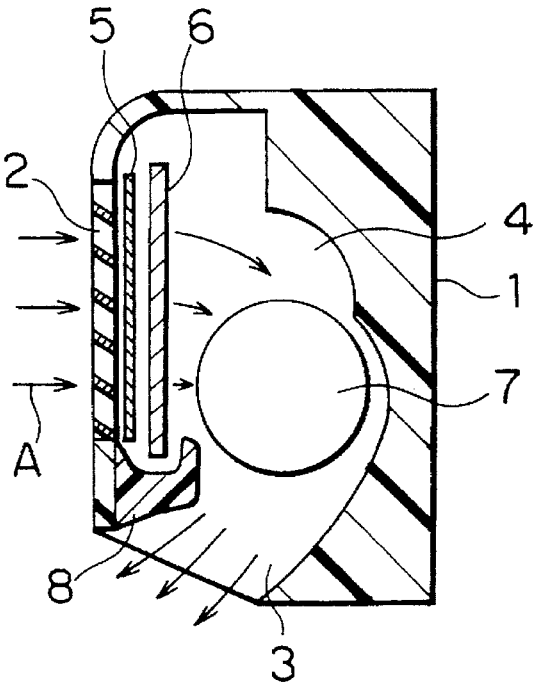
FIG. 25 PRIOR ART
FIG. 25 is a vertical sectional view of a conventional air conditioner.
Figure 29:
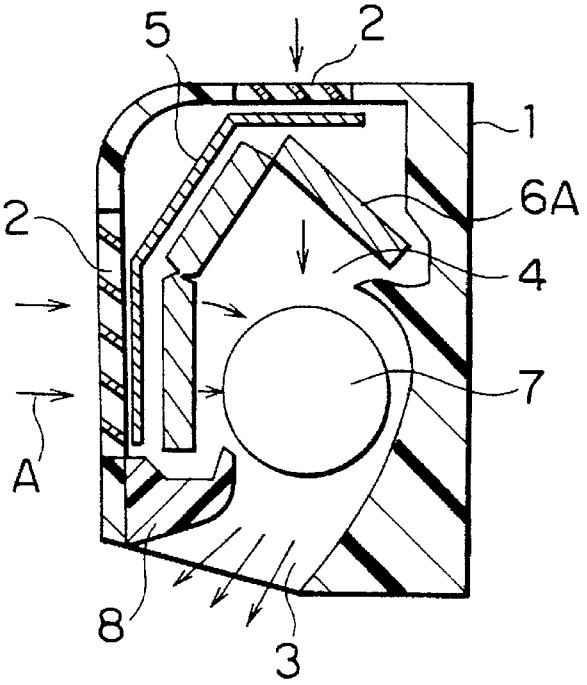
FIG. 29 PRIOR ART
FIG. 29 is a vertical sectional view which shows by way of other example the conventional air conditioner.
Figure 30:
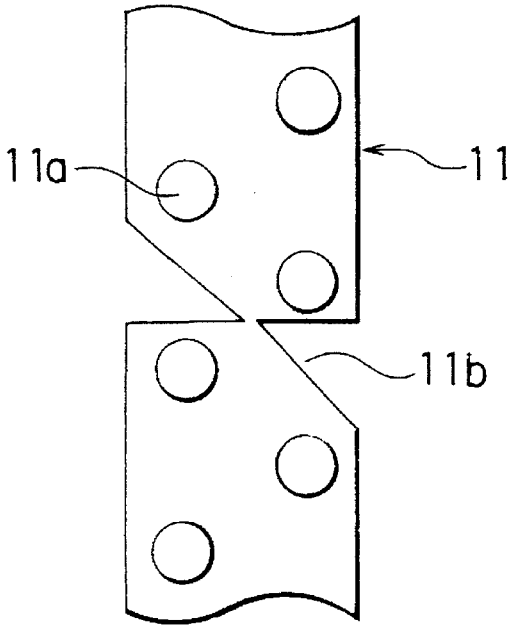
FIG. 30 PRIOR ART
FIG. 30 is a plan view which shows by way of other example essential components constituting a plate fin for the conventional heat exchanger.

FIG. 1 is a sectional view of an air conditioner constructed in accordance with a first embodiment of the present invention, and FIG. 2 is a plan view which shows essential components constituting a heat exchanger for the air conditioner constructed in accordance with the first embodiment of the present invention. Same or similar components in FIG. 1 and FIG. 2 as those shown in FIG. 25 and FIG. 29 are represented by same reference numerals, and repeated description of these components is omitted.

Referring to the drawings, a heat exchanger 20 includes a single row heat conduction pipe group 21 and is disposed at the rear stage of a filter 5 across an air passage 4. The heat conduction pipe group 21 is such that a plurality of heat conduction pipes 22 each having a diameter of about 1 mm are arranged in parallel with each other with a pitch of 4 mm between adjacent ones and a fine wire 23 made of a metallic material e.g., copper or aluminum having excellent heat conductivity and having a diameter of 0.5 mm or less is spirally wound about adjacent heat conduction pipes 22. The adjacent fine wires 23 are spirally wound in the reverse direction, i.e., in the opposite direction. The heat conduction pipe group 21 is constructed such that when the heat exchanger 20 is arranged in a housing 1, each heat conduction pipe 22 orients in the upward/downward direction (in the perpendicular direction in Embodiment 1). Here, a fine wire **23*a* is located on the upstream side relative to air A passing through the fines wires 23, while a fine wire 23*b*** is located on the downstream side relative to the same.

Next, a mode of operation of the air conditioner constructed in accordance with the first embodiment of the present invention will be described below.

As a blower 7 is driven, air A in the room is sucked from a suction grille 2, passes through a filter 5 and conducted to the heat exchanger 20. Heat exchanging is effected between the air A and a working fluid B flowing through each heat conduction pipe 22 of the heat exchanger 20, and subsequently, the air A is blown off from a blow-off port 3.

The air which has reached the heat conduction pipe group 21 of the heat exchanger 20 is conducted to the fine wire **23*b* side past the fine wire 23*a* side. At this time, the flowing of the air is accelerated, and each fine wire 23*a* serves as a turbulent promoting member, causing the flowing of the air A to be three-dimensionally disturbed. Thus, the flowing of air A in the heat conduction pipe group 21 becomes a turbulent flow. As a result, heat conduction is promoted, the surface of the heat conduction pipe group 21** exhibits a high heat conductivity, and air conditioning capability of the air conditioner can be elevated.

Since the fine wire 23 is spirally wound around each adjacent heat conduction pipe 22, no intersection occurs with the fine wire 23 in the cross-sectional area extending at a right angle relative to the axial direction of each heat conduction pipe 22 so that the space between the fine wires as viewed in the flowing direction of air A is enlarged. As a result, air pressure loss can be reduced and a quantity of air flowing per unit driving force of the blower 7 can be increased. Thus, performances of the air conditioner can be elevated.

In addition, since the axial direction of each heat conduction pipe 22 is coincident with the perpendicular direction, in the case that the air conditioner operates as a cooler, when water droplets formed by condensation of moisture in the air A adhere to the surface of the heat exchanger 20, they flow to the heat conduction pipe 22 along wire fires 23, and subsequently, they are downwardly drained along heat conduction pipes 22. Even when the heat exchanger 20 is used while its surface is wetted, there does not arise a malfunction that the air pressure loss is increased.

Further, since the heat exchanger 20 is constructed by heat conduction pipes 22 each having a diameter of about 1 mm and fine wires 23 each having a diameter of 0.5 mm or less, it can be dimensioned to have a small thickness of 1 to 2 mm, whereby there does not arise a necessity for enlarging the volume of a housing 1.

Since the heat conduction pipe group 21 of the heat exchanger 20 is constructed such that heat conduction pipes 22 are arranged in parallel with each other and fine wire 23 is spirally wound around each adjacent heat conduction pipes 22, the capability of the air conditioner can easily be adjusted by changing a pitch between each adjacent heat conduction pipes 22 and a winding pitch of fine wire 23. Thus, productivity of the air conditioner can be improved and a cost of the air conditioner can be reduced.

Embodiment 2.

Figure 3:
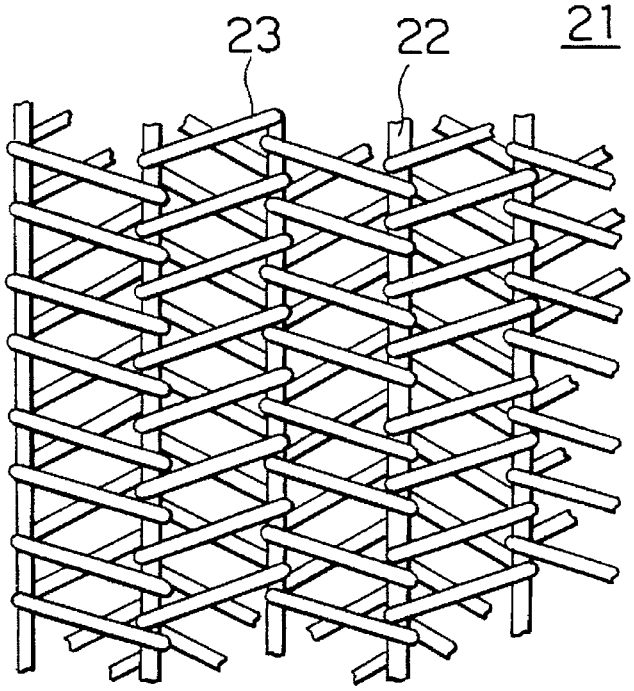
FIG. 3 is a plan view which shows essential components constituting a heat exchanger for an air conditioner constructed in accordance with a second embodiment of the present invention.

In the preceding embodiment, a single fine wire 23 is spirally wound around each adjacent pair of heat conduction pipes 22. In this embodiment, as shown in FIG. 3, two fine wires 23 are spirally wound around each adjacent pair of heat conduction pipes 22, while exhibiting the same advantageous effects as those in the preceding embodiment.

In the second embodiment, the spiral winding direction of two fine wires 23 around the same heat transmission pipes 22 is same but the spiral winding direction of two fine wires 23 around different heat conduction pipes 22 is reversed.

Embodiment 3.

Figure 4:
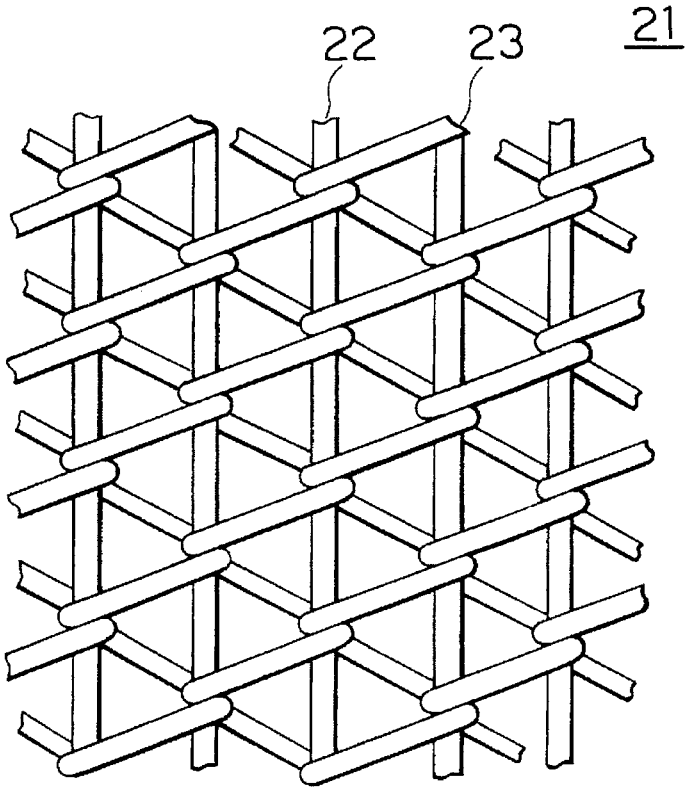
FIG. 4 is a plan view which shows essential components constituting a heat exchanger for an air conditioner constructed in accordance with a third embodiment of the present invention.

In the first embodiment, a single fine wire 23 is spirally wound around adjacent heat conduction pipes 22 and the spiral winding direction of each of adjacent fine wires 23 is reversed. In the third embodiment, as shown in FIG. 4, a single fine wire 23 is spirally wound around each of adjacent heat conduction pipes 22 and the spiral winding direction of adjacent fine wires 23 is the same, while exhibiting the same advantageous effects as those in each of the aforementioned embodiments.

Embodiment 4.

Figure 5:
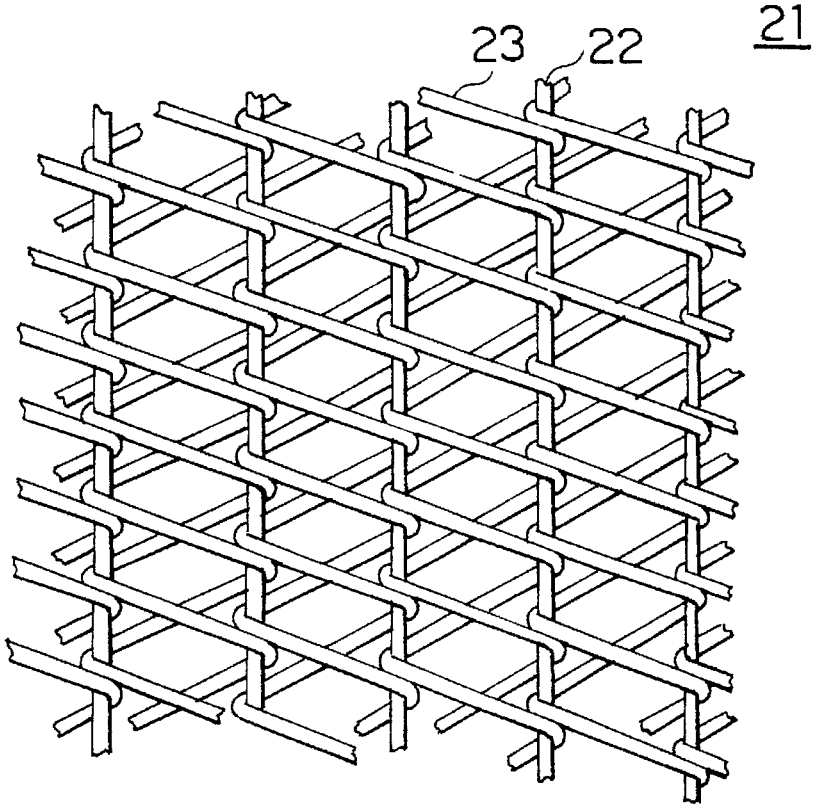
FIG. 5 is a plan view which shows essential components constituting a heat exchanger for an air conditioner constructed in accordance with a fourth embodiment of the present invention.

In the third embodiment, a single fine wire 23 is spirally wound around each of adjacent heat conduction pipes 22 and the spiral winding of each fine wire 23 is the same. In the fourth embodiment, as shown in FIG. 5, two fine wires 23 are spirally wound around adjacent heat conduction pipes 22 and the spiral winding direction of each fine wire 23 is the same, while exhibiting the advantageous effects as those in each of the aforementioned embodiments.

Embodiment 5.

Figure 6:
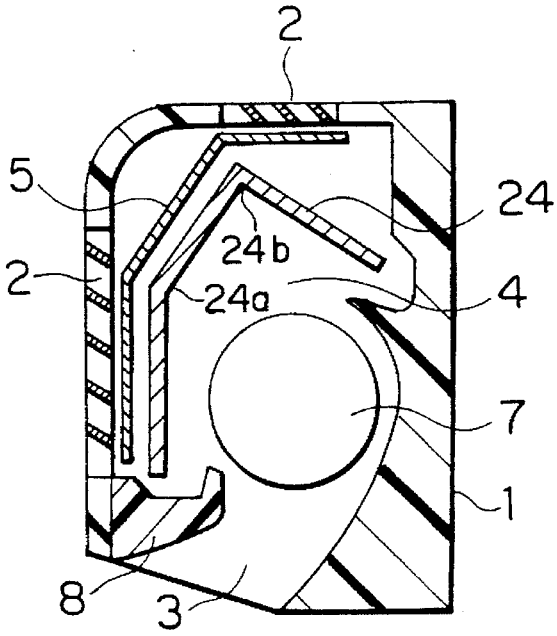
FIG. 6 is a vertical sectional view which shows an air conditioner constructed in accordance with a fifth embodiment of the present invention.

FIG. 6 is a vertical sectional view of an air conditioner constructed in accordance with a fifth embodiment of the present invention. In this embodiment, another suction grille 2 is disposed on the upper surface of a housing 1 to serve as an air suction port. A filter 5 is disposed at the rear stage of the grilles 2 formed in the front surface and upper surface of the housing 1, and a heat exchanger 24 is arranged at the rear stage of the grilles 2.

The heat exchanger 24 includes a heat conduction pipe group which is constructed in the same manner as the heat conduction pipe group 21 for the heat exchanger 20 in the first embodiment. The heat exchanger 24 is constructed to include two bent portions **24*a* and 24*b* which are formed at two locations by bending respective heat conduction pipes along the plane extending at a right angle relative to the parallel extension surface of the heat conduction pipes inclusive of their center, and is disposed across an air passage 4**.

The remaining structure is the same as in the first embodiment.

According to the fifth embodiment, since the air conditioner includes the heat exchanger 24 constructed in the same manner as the heat exchanger 20, the same advantageous effects as those in the first embodiment are obtainable.

In addition, since the heat exchanger 24 includes two bent portions **24*a* and 24*b*, a heat conduction area can be increased and performances of the air conditioner can correspondingly be improved. Since the heat exchanger 24 is constructed by heat conduction pipes each comprising a copper pipe having a diameter of about 1 mm and fine wires each made of a metallic material, e.g., copper or aluminum and having a diameter of 0.5 mm or less, it has a high degree of design flexibility. Thus, each heat conduction pipe can easily be bent at a low cost while suppressing enlargement of the volume of the housing 1**.

In the fifth embodiment, the heat exchanger 24 includes two bent portions **24*a* and 24*b*. However, the number of bent portions should not be limited only to two. Alternatively, the heat exchanger 14** may include three or more bent portions.

Embodiment 6.

Figure 7:
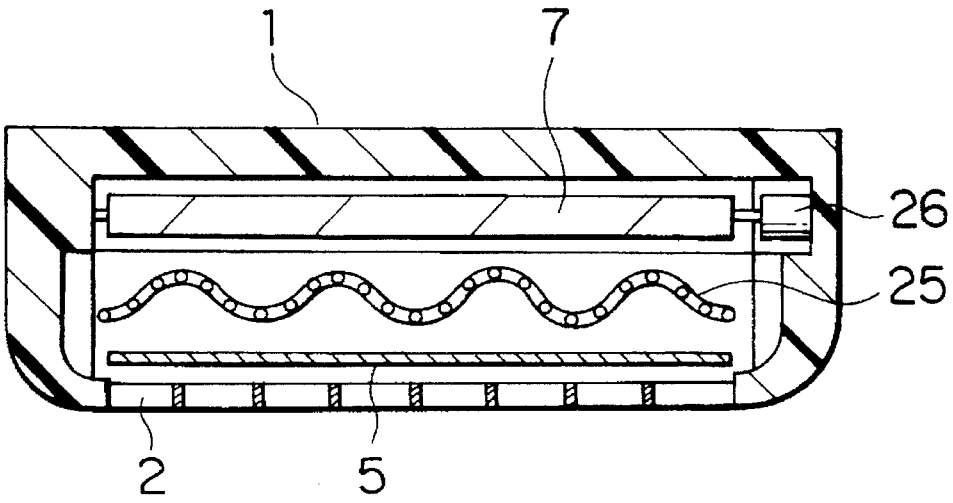
FIG. 7 is a horizontal sectional view which shows an air conditioner constructed in accordance with a sixth embodiment of the present invention.

FIG. 7 is a horizontal sectional view which shows the structure of an air conditioner constructed in accordance with a sixth embodiment of the present invention. In this embodiment, a heat exchanger 25 is arranged at the rear stage of a filter 5, and a motor 26 for driving a blower 7 is disposed in a housing 1.

The heat exchanger 25 includes a heat conduction pipe group constructed in the same manner as the heat conduction pipe group 21 of the heat exchanger in the first embodiment, and the heat conduction pipe group is corrugated at a right angle relative to the axial direction of each heat conduction pipe as well as in the direction of parallel arrangement of the heat conduction pipes and is disposed across an air passage 4.

The remaining structure is the same as in the first embodiment.

According to the sixth embodiment, since the air conditioner includes the heat exchanger 25 constructed in the same manner as the heat exchanger 20, the same advantageous effects as those in the first embodiment are obtainable.

In addition, since the heat exchanger 25 exhibits the corrugated configuration, a heat conduction area can be increased and performance of the air conditioner can correspondingly be improved. Since the heat exchanger 25 is dimensioned to have a small thickness of 1 to 2 mm, the air conditioner has a high degree of design flexibility. The heat exchanger 25 is dimensioned to have a thickness of 1/10 to 1/6 of that of the conventional heat exchanger 6. Thus, even when it is corrugated, the thickness of heat exchanger 25 can be reduced to be smaller than that of the conventional heat exchanger 6. Thus, enlargement of the volume of the housing 1 can be suppressed.

Embodiment 7.

Figure 8:
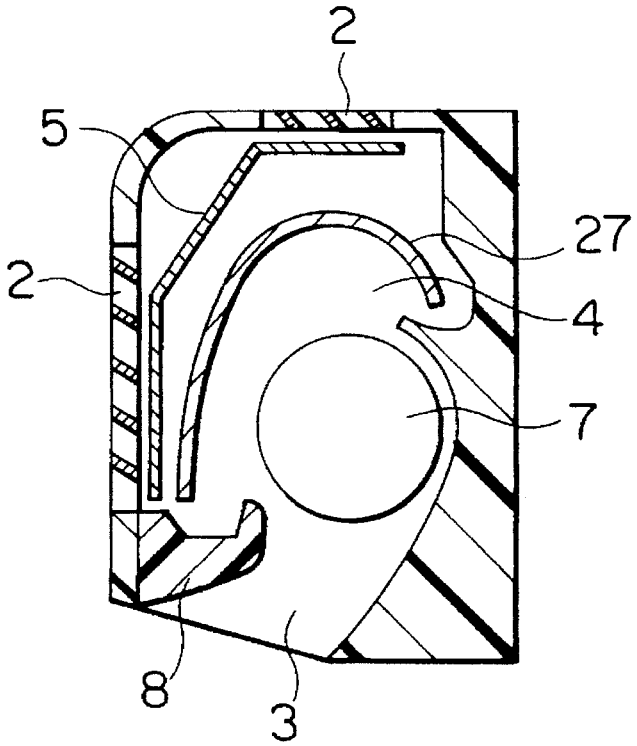
FIG. 8 is a vertical sectional view which shows an air conditioner constructed in accordance with a seventh embodiment of the present invention.

FIG. 8 is a vertical sectional view of an air conditioner constructed in accordance with a seventh embodiment. In this embodiment, a heat exchanger 27 is disposed at the rear stage of a filter 5.

The heat exchanger 27 includes heat conduction pipe group constructed in the same manner as the heat conduction pipe group 21 of the heat exchanger 20 in the first embodiment. This heat exchanger 27 is constructed in an arc-shaped configuration by archedly bending respective heat conduction pipes within the plane extending at a right angle relative to the parallel extension surface of the heat conduction pipes inclusive of their center axes, and is disposed across an air passage 4.

The remaining structure is the same as in the first embodiment.

According to the seventh embodiment, since the air conditioner includes the heat exchanger 27 constructed in the same manner the heat exchanger 20, the same advantageous effects as those in the first embodiment are obtainable.

In addition, since the heat exchanger 27 is formed in an arch-shaped configuration, a heat conduction surface can be increased and performances of the air conditioner can correspondingly be improved. Since the heat exchanger 27 is constructed by heat conduction pipes each comprising a copper pipe having a diameter of about 1 mm and fine wires each made of copper or aluminum and having a diameter of 0.5 mm or less, the air conditioner has a high degree of design flexibility. The respective heat conduction pipes can easily be bent at a low cost, and enlargement of the volume of the housing 1 can be suppressed. Further, since the heat exchanger 27 is formed in the arc-shaped configuration, the gap between the heat exchanger 27 and the blower 7 is making uniform across the whole length of the heat exchanger 27, and generation of noise can be reduced by making uniform the air speed in front of the heat exchanger 27.

Embodiment 8.

Figure 9:
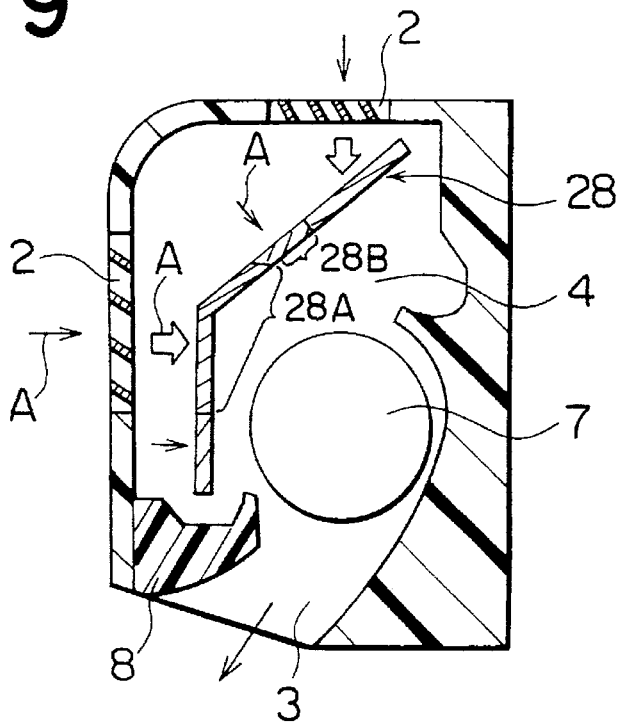
FIG. 9 is a vertical sectional view which shows an air conditioner in accordance with an eighth embodiment of the present invention.
Figure 10:
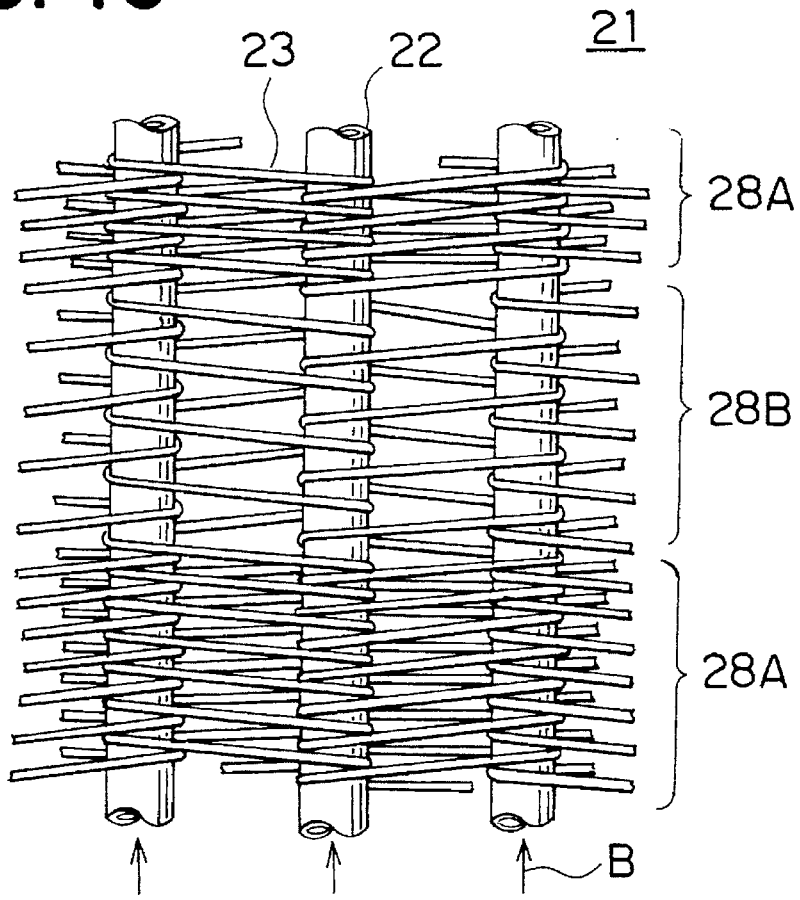
FIG. 10 is a plan view which shows essential components constituting a heat exchanger for the air conditioner constructed in accordance with the eighth embodiment of the present invention.

FIG. 9 is a vertical sectional view which shows the structure of an air conditioner constructed in accordance with an eighth embodiment of the present invention, and FIG. 10 is a plan view which shows essential components constituting an heat exchanger for the air conditioner constructed in accordance with the eighth embodiment of the present invention.

In the eighth embodiment, a heat conduction pipe group 21 constituting the heat exchanger 28 is constructed such that a winding pitch of a fine wire 23 is changeably determined corresponding to an air speed. In other words, the winding pitch of the fine wire 23 is set to a small value within a portion 28A having a high air speed and it is set to a large value within a portion 28B having a low air speed. The remaining structure is the same as in the first embodiment.

Generally, as air is sucked from the suction grille 2 of the air conditioner, there arise two parts depending on the contour of the suction grille 2, one of them being a part having a high air speed and the other one being a part having a low air speed. Since a value representing a magnitude of noise generated by the air conditioner is determined corresponding to the part having a highest air speed, when such speed distribution appears, the value representing a magnitude of noise generated by the air conditioner is elevated. When it is intended to reduce the value representing a magnitude of noise generated by the air conditioner, it is necessary that an air speed is lowered. This leads to the result that a quantity of air required for assuring a necessary quantity of heat exchanging can not be maintained, and performances of the heat exchanger are degraded.

With the heat exchanger constructed in accordance with the eighth embodiment, since the fine wire 23 is wound with a small pitch at the part 28A having a high air speed, and the fine wire 23 is wound with a large pitch at the part 28B having a low air speed an air speed in front of the heat exchanger can be made uniform, the value representing a magnitude of noise generated by the air conditioner can be reduced, and moreover, performances of the heat exchanger can be improved without any elevating of the value representing a magnitude of noise.

Embodiment 9.

Figure 11:
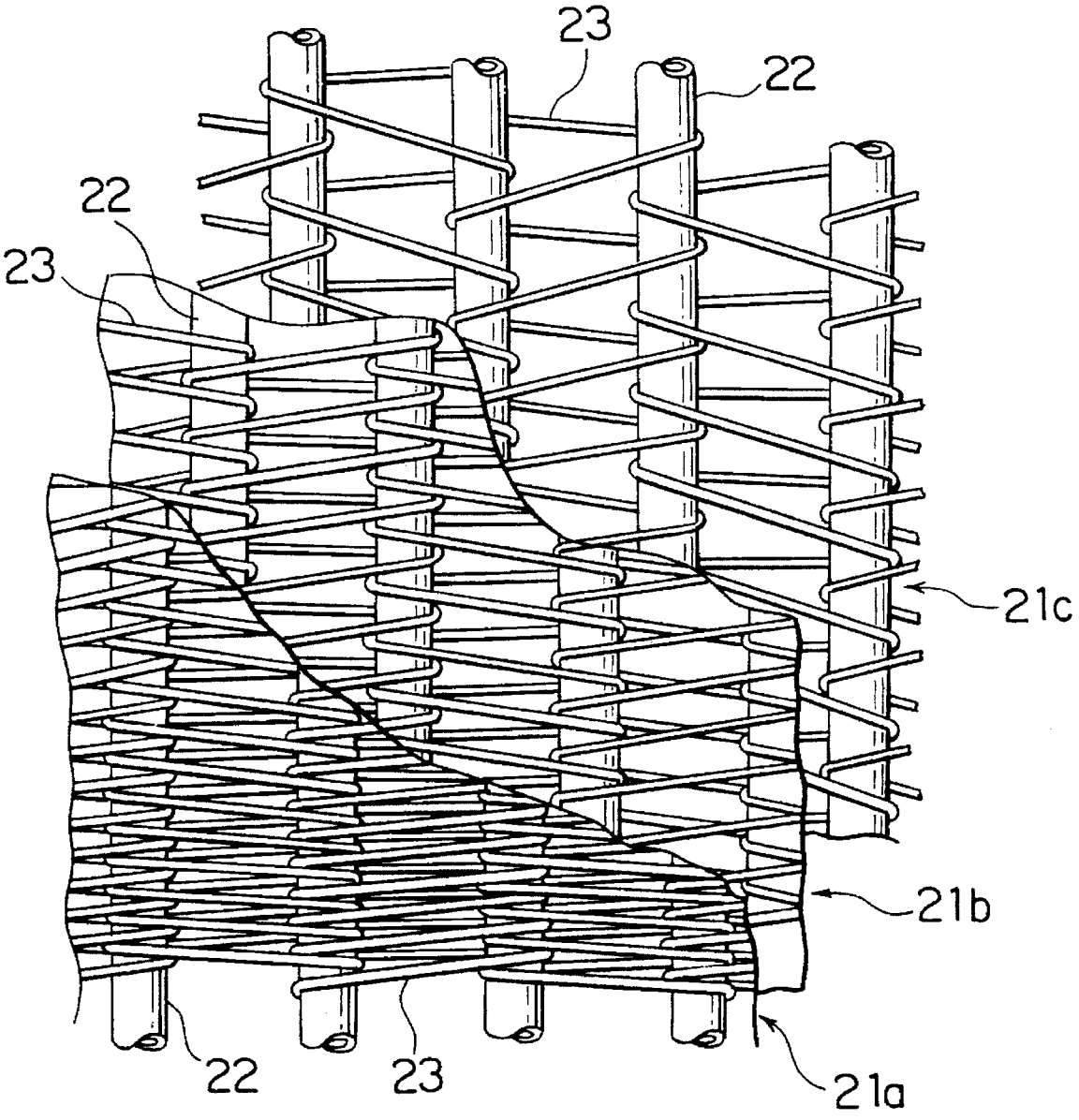
FIG. 11 is a partially exposed plan view which shows essential components constituting a heat exchanger for an air conditioner constructed in accordance with a ninth embodiment of the present invention.

FIG. 11 is a partially exposed plan view which shows essential components constituting a heat exchanger of an air conditioner constructed in accordance with a ninth embodiment of the present invention. In this ninth embodiment, the heat exchanger is constructed by first, second and third heat conduction pipe groups 21*a*, 21*b* and 21*c* which are successively arranged from the upstream side to the downstream side as viewed in the air flowing direction. A winding pitch of a fine wire 23 is determined to have a large value in accordance with the order of the first heat conduction pipe group 21*a*, the second heat conduction pipe group 21*b* and the third heat conduction pipe group 21*c*.

The remaining structure is the same as in the first embodiment.

In this ninth embodiment, as air A is sucked from the suction grille 2 and passes through the filter 5, first, heat exchanging is effected between the air A and a working fluid B passing through respective heat conduction pipes 22 of the first heat conduction pipe group 21*a*, subsequently, heat exchanging is effected between the air A and the working fluid B passing through respective heat conduction pipes 22 of the second heat conduction pipe group 21*b*, and moreover, heat exchanging is effected between the air A and the working fluid B passing through respective heat conduction pipes 22 of the third heat conduction pipe group 21*c*, whereby the temperature of the air A is lowered or raised up to a desired temperature and is blown off via the blow-off port 3.

At this time, the most upstream heat conduction pipe group has an especially large quantity of heat exchanging, and a quantity of heat exchanging is increasingly reduced toward the downstream side. In other words, the first heat conduction pipe group 21*a* contributes mainly to cooling or heating of air. Since a winding pitch of fine wire 23 is set to a small value at the first heat conduction pipe group 21*a*, and air speed is increased, three dimensional turbulence becomes large, causing heat conduction to be promoted, so that a large temperature difference between before heat exchanging and after heat exchanging is realized. Since a winding pitch of the fine wire 23 is enlarged at the second heat conduction pipe group 21*b*, a quantity of heat exchanging is correspondingly reduced but pressure loss becomes small compared with the first heat conduction pipe group 21*a*. Since a winding pitch of the fine wire 23 is further enlarged at the third heat conduction pipe group 21*c*, a quantity of heat exchanging is further reduced compared with the first heat conduction pipe group 21*a*.

In such manner, according to the ninth embodiment, since heat exchangers are arranged in parallel with each other in the spaced relationship in the form of three rows, a heat conduction area of the heat exchanger can be increased. In addition, a winding pitch of the fine wire 23 is successively increased from the upstream side to the downstream side of air A among three heat conduction pipe groups, increasing of the air pressure loss as the whole heat exchanger can be suppressed, and a quantity of air required for assuring a necessary quantity of heat exchanging can sufficiently be maintained.

Embodiment 10.

Figure 12:
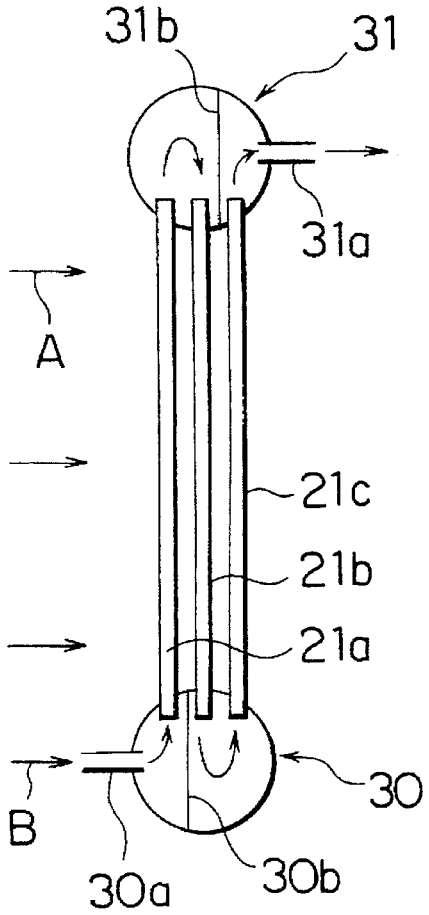
FIG. 12 is a side view which shows an air conditioner constructed in accordance with a tenth embodiment of the present invention.

FIG. 12 is a side view of a heat exchanger for an air conditioner constructed in accordance with a tenth embodiment of the present invention. In this tenth embodiment, a lower distributor 30 and an upper distributor 31 are arranged at the lower parts and the upper parts of the first, second and third heat conduction pipe groups 21*a*, 21*b* and 21*c*. The lower distributor 30 includes a feeding port 30*a* for the working fluid B and a partition plate 30*b*, while the upper distributor 31 includes a discharging port 31*a* for the working fluid B and a partition plate 31*b*. The remaining structure is the same as in the ninth embodiment.

With the heat exchanger constructed in accordance with the tenth embodiment, as the working fluid B is fed to the lower distributor 30 from the feeding port 30*a*, it reaches the upper distributor 31 while passing through respective heat conduction pipes 22 of the first heat conduction pipe group 21*a*, then, it reaches the lower distributor 30 while passing through respective heat conduction pipes 22 of the second heat conduction pipe group 21*b*, subsequently, it reaches the upper distributor 31 while passing through respective heat conduction pipes 22 of the third heat conduction pipe group 21*c*, and finally, it is discharged from the discharge port 31*b*. Heat exchanging is executed between the working fluid B and the air A as the working fluid B flows through the respective heat conduction pipes 22.

Here, description will be made below with respect to the case where the air conditioner performs cooling operation.

While the working fluid B flows through the respective heat conduction pipes 22, it is evaporated by heat exchanging between the working fluid B and the air A. A quantity of heat exchanging between the working fluid B and the air A is increased as the flow passage is elongated more and more, and a quantity of evaporation of the working fluid B is increased. In the worst case, the working fluid B is completely vaporized and gasified at the tail of the heat conduction pipes 22, causing the heat exchanger not to contribute to cooling of the air A because of the dried state.

When a part of the heat conduction pipe group constituting the heat exchanger is held in the dried state as viewed in the direction of flowing of the air A, the air A passing this dried part is delivered to the air passage 4 as it is kept wet at a high temperature. When the air having a high temperature and a high humidity is condensed and liquidized by mixing with the air having a low temperature and a low humidity in the air passage 4, there appears a phenomenon that dew droplets are discharged from the blow-off port 3. Such phenomenon remarkably appears in the case that the air conditioner operates under the moist cooling condition that air has large enthalpy and a quantity of heat exchanging is large.

According to the tenth embodiment, since the working fluid B flows from the first heat conduction pipe group 21*a* on the most upstream side to the third heat conduction pipe group 21*c* on the most downstream side via the second heat conduction pipe group 21*b*, the dried state arises in the heat conduction pipes 22 of the third heat conduction pipe group 21*c*, even if a dried state arises. Therefore, since the air A passing the range where the third heat conduction pipe group 21*c* is held in the dried state is transformed into the state having a low temperature and a low humidity attributable to heat exchanging at the first and second heat conduction pipe groups 21 and 21*b*, the dew droplets discharging phenomenon can be prevented, resulting in a quality of heat exchanging being elevated.

Embodiment 11.

Figure 13:
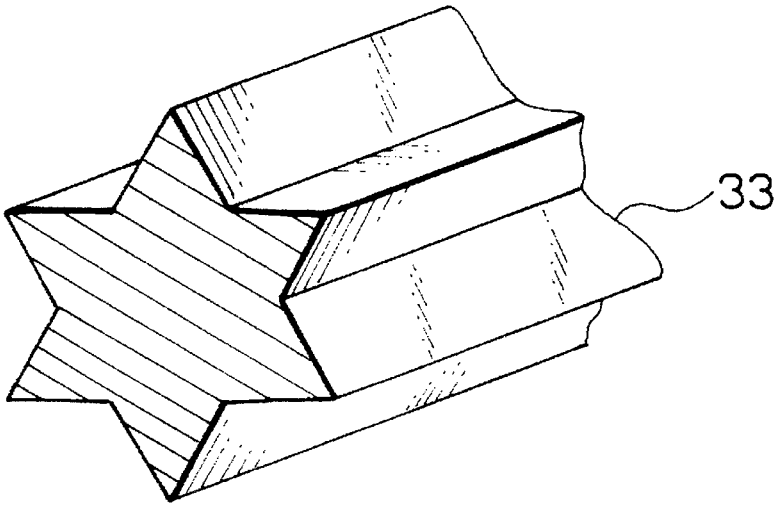
FIG. 13 is a exposed perspective view which shows a fine wire for an air conditioner constructed in accordance with an eleventh embodiment of the present invention.

FIG. 13 is a exposed perspective view of a fine wire for an air conditioner constructed in accordance with an eleventh embodiment of the present invention. This eleventh embodiment is same to each of the aforementioned embodiments with the exception that the fine wire 33 has a star-shaped polygonal cross-sectional contour.

According to the eleventh embodiment, since the fine wire 33 has a polygonal cross-sectional contour, an outer surface area of the fine wire 33 is enlarged compared with the fine wire 23 having a circular cross-sectional view even though it has a same cross-sectional area. Consequently, a heat conduction area can be enlarged, and moreover, a quantity of heat exchanging can be increased.

In the eleventh embodiment, the fine wire 33 has a star-shaped polygonal cross-sectional contour. However, the outermost end of the star-shaped cross-sectional area should not be limited only to a sharpened end. Alternatively, the outermost end may exhibit a semicircular contour.

In addition, in the eleventh embodiment, the fine wire has a polygonal contour. However, the same advantageous effects are obtainable even when each heat conduction pipe has a polygonal cross-sectional shape.

In each of the first to eleventh embodiments, it is assumed that each heat conduction pipe 22 constituting the heat condition pipe group for the heat exchanger has an axial direction which orients in the upward/downward direction. However, the same advantageous effects are obtainable when the heat conduction pipe 22 constituting the heat conduction pipe group has an axial direction which orients in the horizontal direction.

Embodiment 12.

Figure 14:
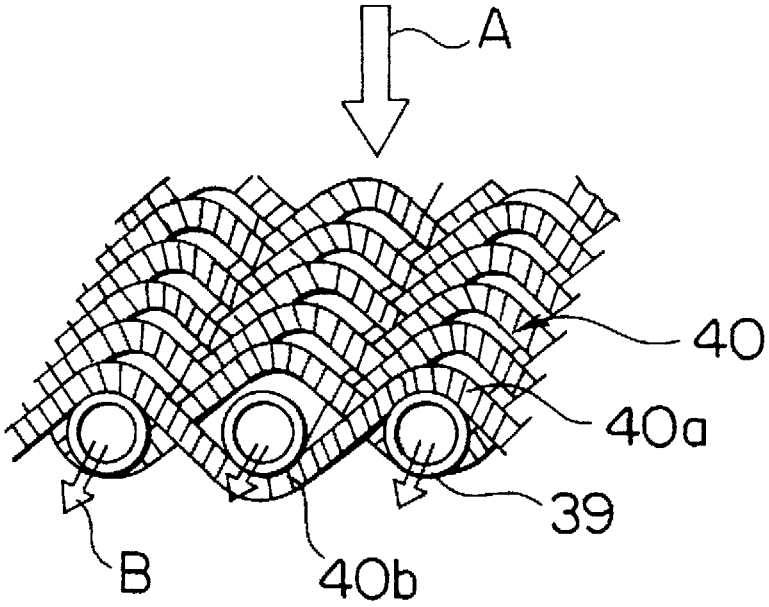
FIG. 14 is a perspective view which shows essential components constituting a heat exchanger constructed in accordance with a twelfth embodiment of the present invention.
Figure 15:
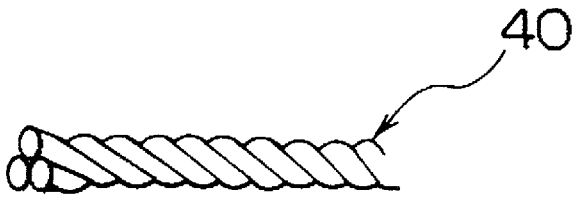
FIG. 15 is a perspective view which shows a twisted wire for the heat exchanger constructed in accordance with the twelfth embodiment of the present invention.

FIG. 14 is a perspective view which shows essential components constituting a heat exchanger constructed in accordance with a twelfth embodiment of the present invention, and FIG. 15 is a perspective view which shows a twisted wire for the heat exchanger constructed in accordance with the twelfth embodiment of the present invention.

Referring to the drawings, a row of heat conduction pipes 39 are arranged in an equally spaced relationship. A working fluid B is caused to flow through the heat conduction pipe 39 (at a speed of, e.g., 2 to 10 m/sec in the case of refrigerant gas, 0.1 to 1 m/sec in the case of fluid, and intermediate value in the case of two phases). A twisted wire 40 is constructed such that three fine wires each having a diameter of 0.3 mm are twisted and wound together to serve as a heat conduction fin.

The twisted wire 40 is knitted such that it is alternately brought in contact with one side and the other side of each of a row of heat conduction pipes 39. Knitting of the twisted wire 40 is successively repeated in the longitudinal direction of the heat conduction pipe 39. At this time, the twisted wires 40 are arranged such that they are alternately brought in contact with one side and opposite other side of the heat conduction pipe 39 as viewed in the longitudinal direction of the heat conduction pipe 39.

Here, the heat conduction pipe 39 is dimensioned to have a diameter of 1 mm and a pitch between adjacent heat conduction pips 39 is set to 4 mm.

A fine wire constituting the twisted wire 40 is made of a metallic material having excellent heat conductivity, e.g., copper and has a diameter of 0.3 to 0.5 mm. It is desirable that the number of fine wires is such that a product of the number of fine wires multiplied by the diameter of fine wire is I mm or less. With this construction, external working fluid A can come in contact with the heat conduction pipe 39 without any particular obstruction given by the twisted wires 40, whereby excellent heat conduction and strength are reliably assured.

Figure 16:
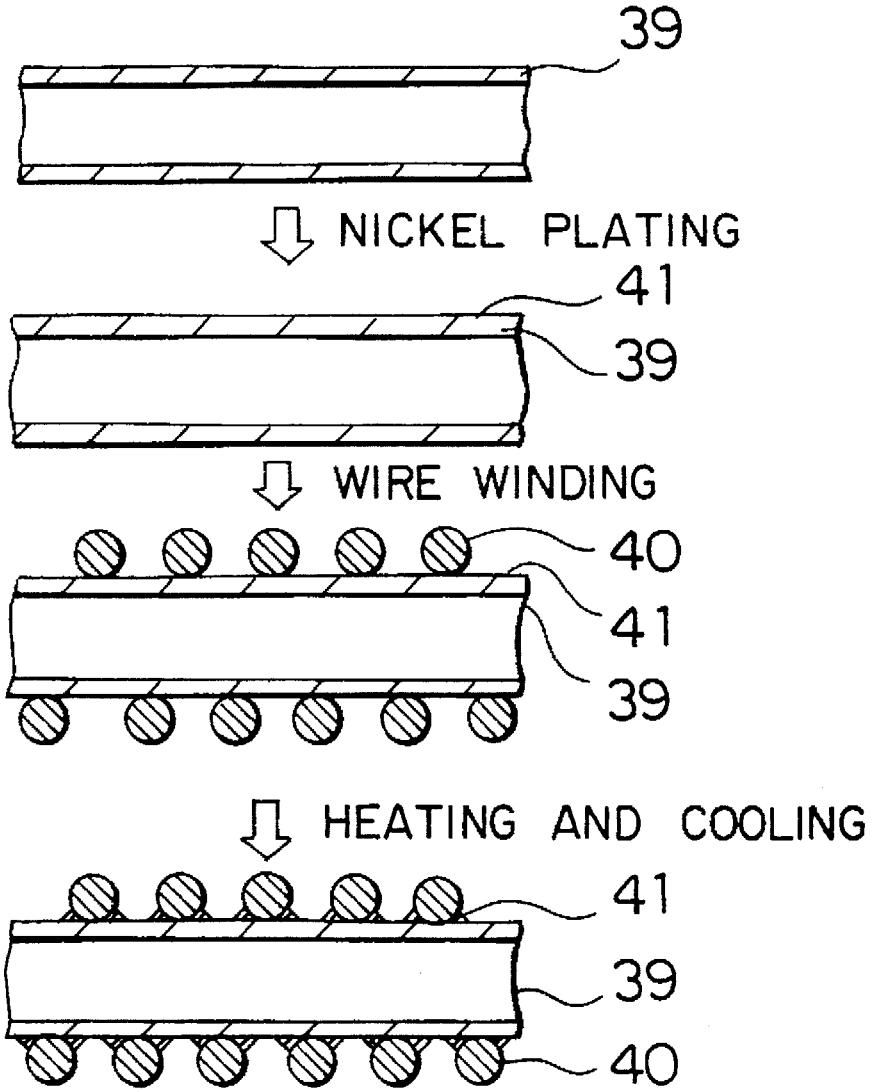
FIG. 16 is a step diagram which shows a series of steps for producing the heat exchanger constructed in accordance with the twelfth embodiment of the present invention.

Next, a method of producing a heat exchanger of the foregoing type will be described below with reference to FIG. 16. First, a heat conduction pipe 39 made of copper is subjected to plating while it is dipped in a non-electrolytic nickel plating solution (nickel: 87 to 93%, phosphor: 4 to 12% and other: 1%) at 90 τ in order to form a nickel plated film to serve as a coating layer 41 for the heat conduction pipe 39. At this time, a thickness of the film is controlled to assume a value of 1 to 10 μm depending on the plating time. Next, a twisted wire 40 made of copper is knitted about each of plated heat conduction pipes 39 to hold the heat conduction pipes 39 in a row.

The thus prepared heat conduction pipes 39 are placed in a soldering furnace having a vacuum atmosphere (about $10^{-3}$ Torr) so that it is heated at 950 τ for 30 minutes. By heating treatment, the nickel plated coating layer 41 is molten, and molten nickel is collected at the contact part with the twisted wire 40 attributable to surface tension and wettablity so as to form a fillet. On completion of the heating treatment, the nickel plated coating layer 41 is solidified and fixed the twisted wire 40 on the heat conduction pipe 39. Compared with the conventional knitting method, since the heat conduction pipe 39 and the twisted wire 40 are connected to each other in the same manner as soldering, thermal contact is reliably assured therebetween so that a fin efficiency of the twisted wire 40 serving as a fin is improved and a thermal efficiency as a heat exchanger is improved.

Incidentally, solder plating may be substituted for the nickel plating.

Figure 31:
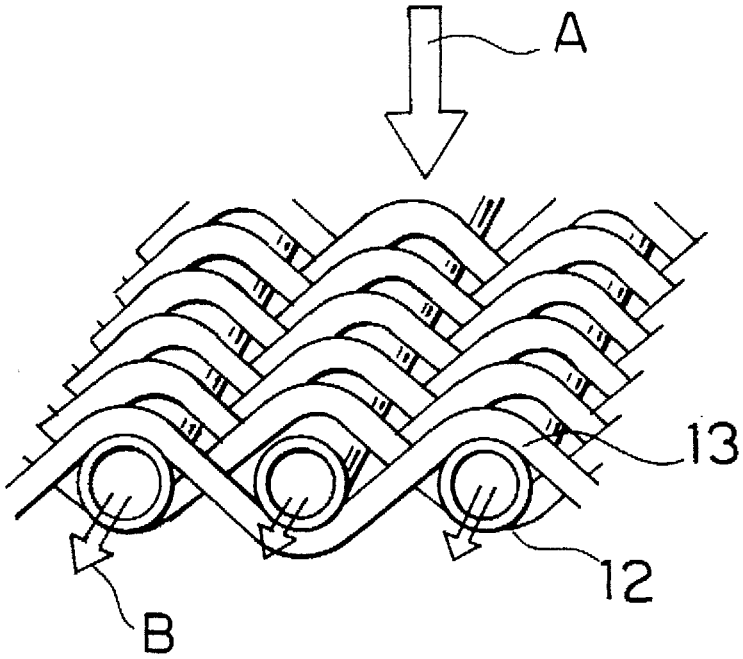
FIG. 31 PRIOR ART
FIG. 31 is a perspective view of the conventional heat exchanger which shows by way of other example essential components constituting the heat exchanger.
Figure 32:
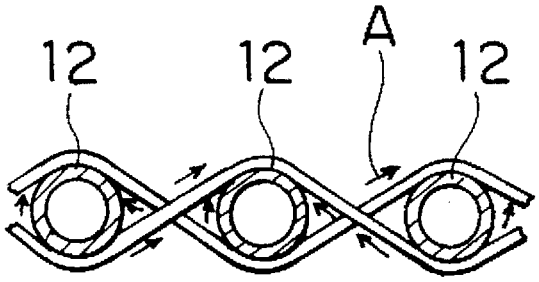
FIG. 32 PRIOR ART
FIG. 32 is a sectional view which shows by way of other example the conventional heat exchanger.

Next, a mode of operation of the heat exchanger will be described below. An external working fluid A, i.e., air having a flowing speed of 0.6 m/sec and a Reynolds number of 100 or more can not move straight through the heat exchanger but flows through the gap between a knitted twisted wire 40*a* on the upstream side and a heat conduction pipe 39 as if sewing is effected, and at the same time when the flowing of air is accelerated, a fine swirl is formed. The thus formed swirl does not merely flow down but is received by an intersection defined by a twisted wire 40*b* on the downstream side and a heat conduction pipe 39 to generate a fine swirl again. The two swirls are jointed together and flow to form turbulence. As a result, heat conduction is promoted and the air exhibits heat conductivity as large as three times as shown in FIG. 17 compared with a conventional heat exchanger as shown in FIG. 31.

Figure 17:
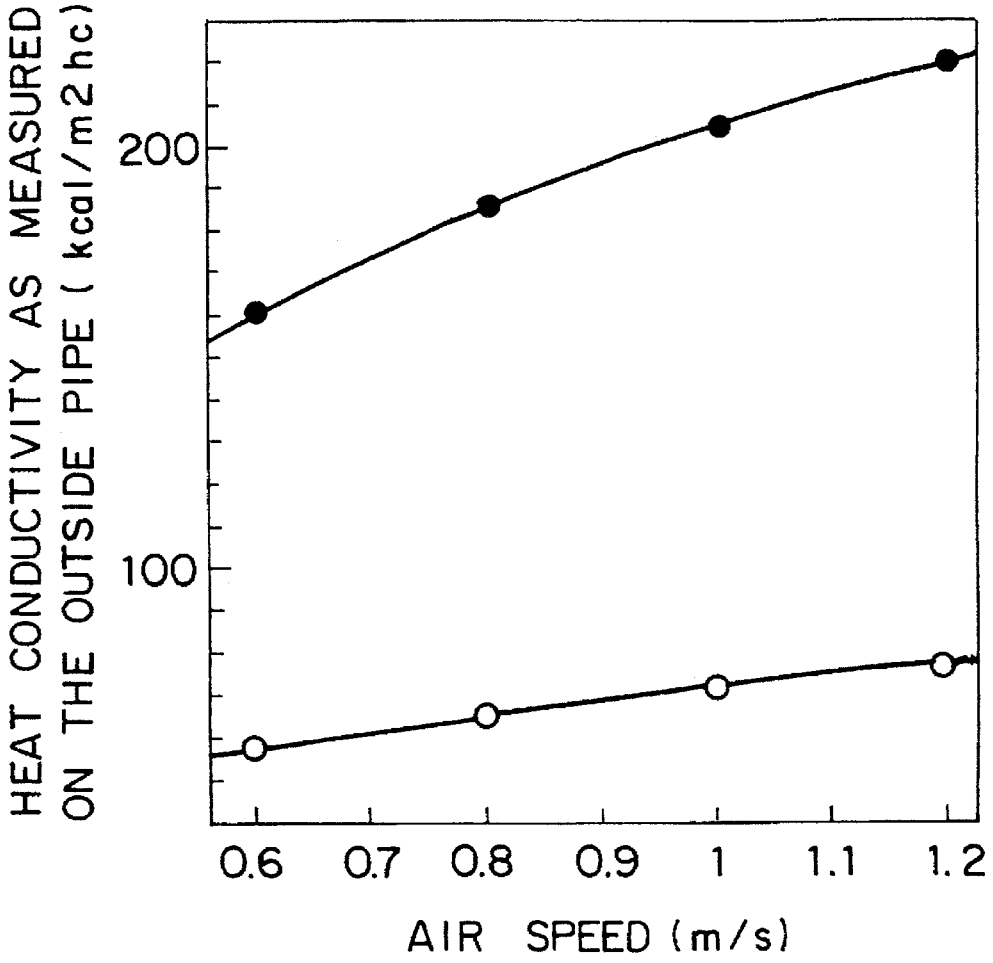
FIG. 17 is a graph which shows a relationship between air flowing speed and heat conductivity in the heat exchanger constructed in accordance with the twelfth embodiment of the present invention and a conventional heat exchanger.

FIG. 17 shows the relationship between a flowing speed of an external working fluid and heat conductivity as measured outside of the heat conduction pipe while comparing the conventional heat exchanger and the heat exchanger of the present invention. While air flows at a flowing speed of 0.6 to 1.2 m/s, the heat exchanger of the present invention exhibits heat conductivity as large as three times compared with the conventional heat exchanger.

By using a twisted wire 40 with a plurality of fine wires twisted and wound thereabout, a heat conduction area is increased much more than that of the conventional heat exchanger, heat conduction is promoted by improvement of the fin efficiency, and a quantity of heat exchanging is substantially increased.

Figure 26:
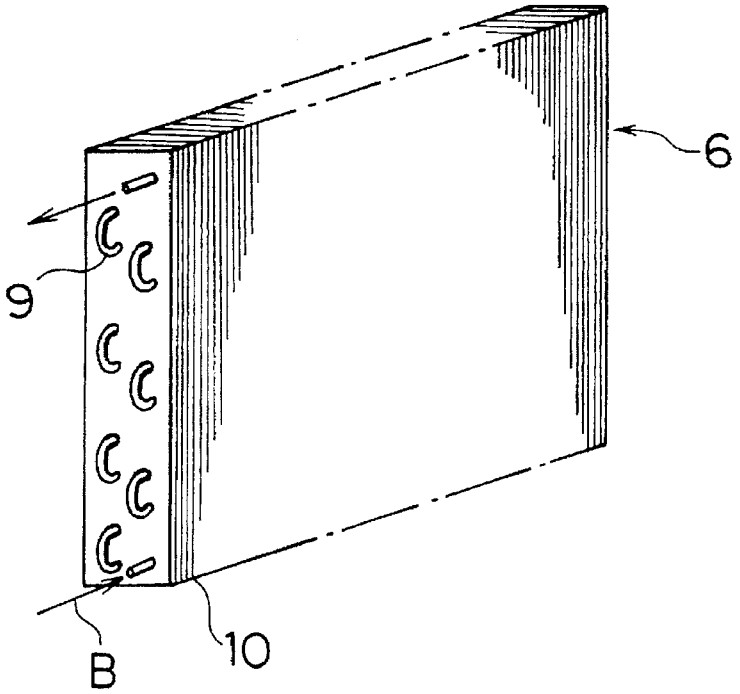
FIG. 26 PRIOR ART
FIG. 26 is a perspective view of a heat exchanger for the conventional air conditioner.
Figure 27:
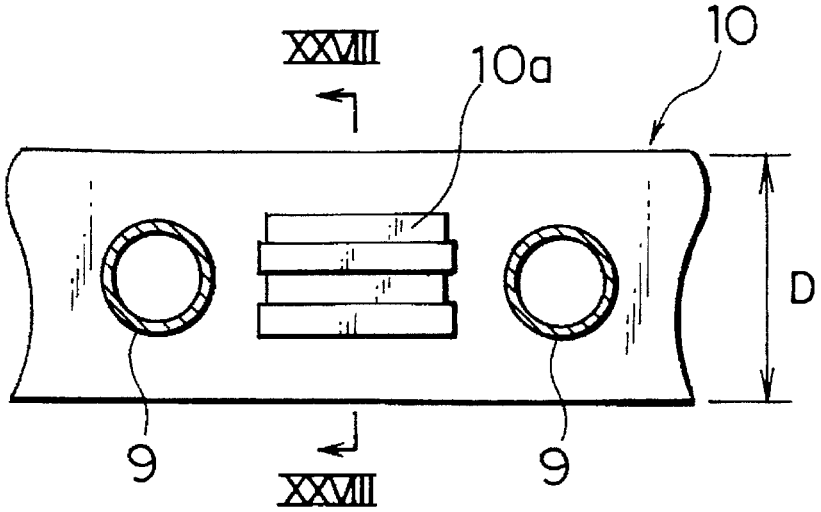
FIG. 27 PRIOR ART
FIG. 27 is a plan view which shows essential components constituting a plate fin for the conventional heat exchanger.
Figure 28:
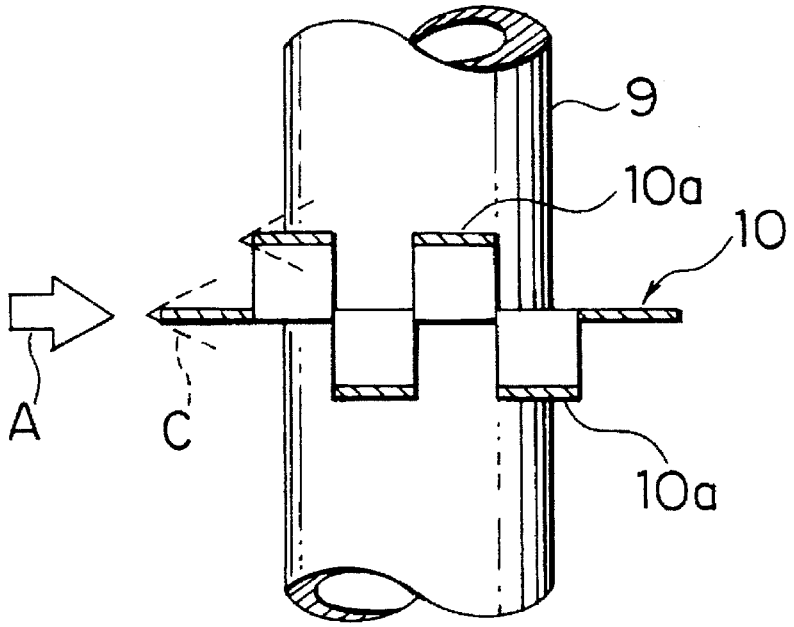
FIG. 28 PRIOR ART
FIG. 28 is a sectional view of the plate fin taken along line XXVIII—XXVIII in FIG. 27.

In this case, since a width of the heat exchanger is reduced to a level of about 1/10 compared with the heat exchanger as shown in FIG. 26, the volume assumed by the heat exchanger is reduced to a level of about 1/10, whereby it becomes possible to compactly design the heat exchanger with reduced weight.

Figure 18:
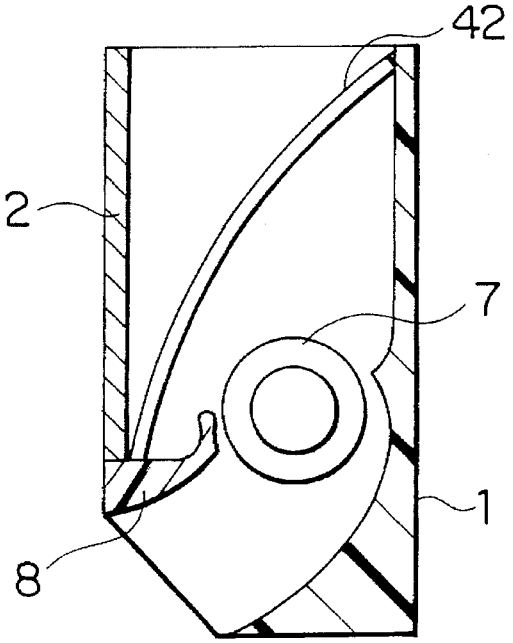
FIG. 18 is a vertical sectional view which shows an air conditioner including the heat exchanger constructed in accordance with the twelfth embodiment of the present invention.

One example is the case that the thus constructed heat exchanger is mounted on an air conditioner is shown in FIG. 18. In this case, since the heat exchanger 42 is constructed by small pipes and fine wires, it is easy to bend them, and moreover, since a heat conduction pipe 39 can be fabricated to assume an elliptical sectional contour, a heat conduction area can be increased.

Figure 19:
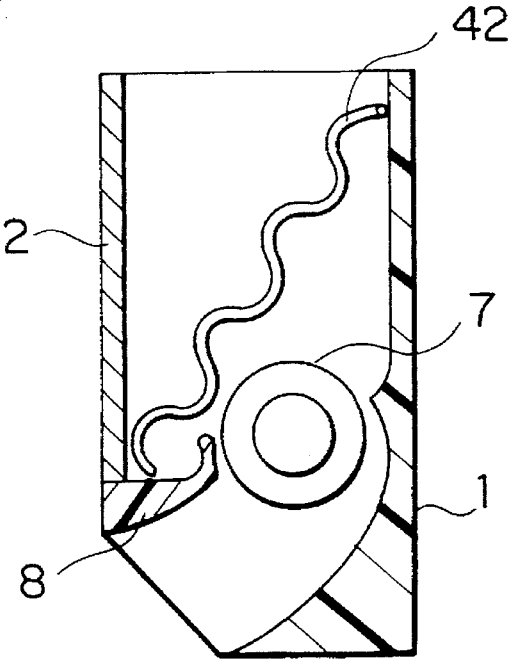
FIG. 19 is a sectional view which shows another air conditioner including the heat exchanger constructed in accordance with the twelfth embodiment of the present invention.

Another example is the case that the thus constructed heat exchanger is mounted on an air conditioner is shown in FIG. 19. In this case, the heat exchanger 42 is constructed to exhibit a corrugated contour, resulting in a heat conduction area being increased.

Embodiment 13.

Figure 20:
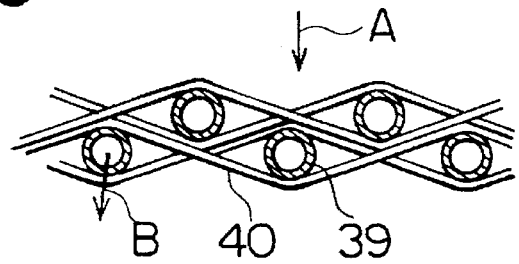
FIG. 20 is a sectional view of a heat exchanger constructed in accordance with a thirteenth embodiment of the present invention as viewed in the direction at a right angle relative to a heat conduction plane thereof.

FIG. 20 is a sectional view which shows the state that a heat exchanger constructed in accordance with a thirteenth embodiment of the present invention is viewed in the direction at a right angle relative to a heat conduction surface. In the thirteenth embodiment, a plurality of heat conduction pipes 39 are arranged with a vertical attitude in the form of two rows. Twisted wires 40 are alternately knitted on opposite sides of each heat conduction pipe 39 along the latter. Twisted wires 40 are assembled in the longitudinal direction of heat conduction pipes 39 in such a manner that the heat conduction pipes 39 are alternately arranged and the twisted wires 40 come in contact with each other between the heat conduction pipes 39. In such manner, since the twisted wires 40 come in contact with each other, heat is conducted between the twisted wires 40, causing heat conduction to be promoted.

In the case that the thus constructed heat exchanger is used, the rear row of heat convection pipes 39 is arranged at the central position of the fore row of heat conduction pipes 39 relative to the direction of air flowing, and the fore and rear rows of heat conduction pipes 39 come in contact with the opponent twisted wire intersections via the twisted wires 40. Thus, in the case that liquid droplets arise on the twisted wires, since they are downwardly conducted along the heat conduction pipes 39, a quantity of liquid droplets held on the surface of the heat exchanger is reduced and reduction of a quantity of heat exchanging due to reduction of a quantity of air flowing is suppressed. In addition, since the heat conduction pipes 39 come in contact with the opponent twisted wire intersection via the twisted wires 40, heat conduction is promoted.

Figure 21:
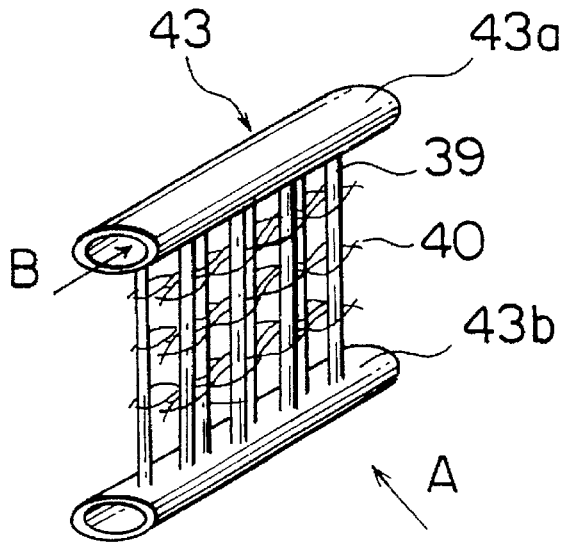
FIG. 21 is a perspective view which shows the heat exchanger constructed in accordance with the thirteenth embodiment of the present invention.

With this heat exchanger, as shown in FIG. 21, a feeding header 43*a* and a discharging header 43*b* are connected to the opposite sides of the heat conduction pipes 39 so that an internal working liquid is fed to the vertically arranged heat conduction pipes 39 and is then discharged to the discharge header 43*b*. The heat conduction pipes 39 are arranged in the form of two rows on the upstream side and the downstream side of the external working liquid A so that liquid droplets adhering to the intersection of the twisted wires 40 fall down along the heat conduction pipes 39.

Embodiment 14.

Figure 22:
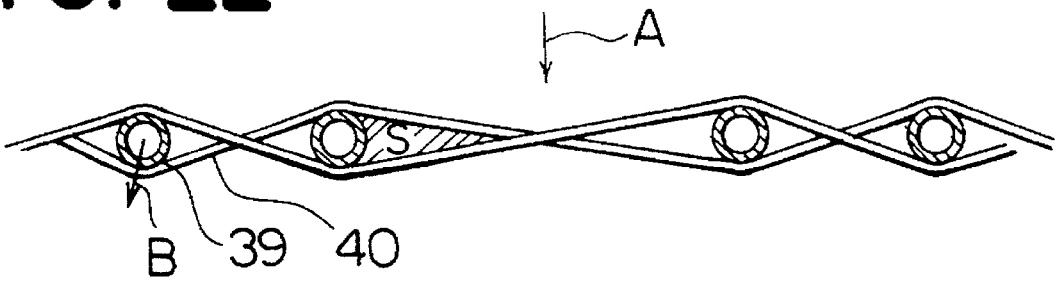
FIG. 22 is a sectional view of a heat exchanger constructed in accordance with a fourteenth embodiment of the present invention as viewed in the direction at a right angle relative to a heat conduction plane thereof.

FIG. 22 is a sectional view of a heat exchanger constructed in accordance with a fourteenth embodiment of the present invention as viewed in the direction at a right angle relative to a heat conduction surface. In this fourteenth embodiment, heat conduction pipes 39 are arranged in a row in such a manner that one or several conduction pipes are omitted between adjacent heat conduction pipes 39. The twisted wires 40 are alternately brought in contact with one side and other side of each of a row of heat conduction pipes 39. Knitting of the twisted wire 40 is successively repeated in the longitudinal direction of the heat conduction pipe 39. At this time, the twisted wires 40 are arranged such that they are alternately brought in contact with one side and opposite other side of the heat conduction pipe 39 as viewed in the longitudinal direction of the heat conduction pipe 39. Adjacent twisted wires 40 come in contact with each other between adjacent heat conduction pipes 39.

Figure 23:
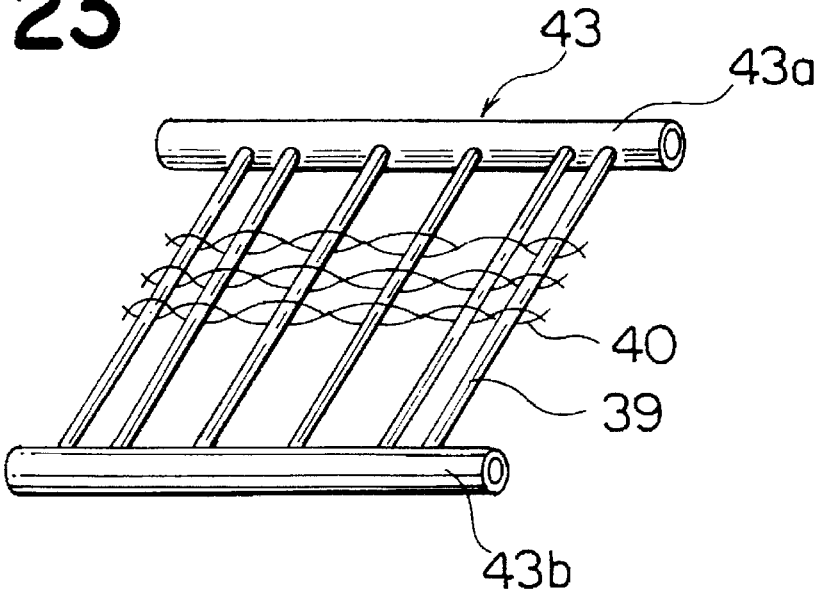
FIG. 23 is a perspective view of the heat exchanger constructed in accordance with the fourteenth embodiment of the present invention.

FIG. 23 shows the case that one heat conduction pipe is omitted between adjacent heat conduction pipes 39. A header 43 is connected to the opposite ends of the heat conduction pipes 39, and an internal working fluid B is fed to the heat conduction pipes 39 from a header 43*a* and discharged to a header 43*b* from the heat conduction pipes 39.

Air can not flow straight through the heat exchanger but flows through the gap between the knitted twisted wires and the heat conduction pipes as if sewing. At the same time when air flowing is accelerated, small swirl is formed. The thus formed swirl does not merely flow down but is received by an intersection to the twisted wires 40 on the downstream side and the heat conduction pipes 39 to form another small swirl. Two swirls are jointed to each other to form turbulence. As a result, heat conduction is promoted and the heat exchanger exhibits high heat conductivity.

With a heat exchanger constructed in accordance with the fourteenth embodiment, since the heat conduction pipes 39 are arranged such that one heat conduction pipe is omitted between adjacent ones, and a distance between the adjacent heat conduction pipes 39 is sufficiently wide to be equal to four times the diameter of a single heat conduction pipe 39, an intersection angle defined by twisted wires 40 as viewed on a sectional surface extending at a right angle relative to the heat conduction surface is increased. Therefore, an air passage area S surrounded by the intersection to the twisted wires 40 and the heat conduction pipe 39 becomes large. Even if the heat exchanger operates under a condition that moisture in the air is condensed, there hardly arises a malfunction that the surface of the heat exchanger is clogged with dew droplets. Thus, reduction of a quantity of heat exchanging due to reduction of a quantity of air flowing can be suppressed.

It is acceptable that a distance between adjacent heat conduction pipes is set to be sufficiently wide at a location where the external working fluid A flows at a high flow rate and is set to be small at a location where the external working fluid A flows at a low flow rate. In such manner, an occurrence of clogging can effectively be prevented and reduction of a quantity of heat exchanging can be suppressed.

Embodiment 15.

Figure 24:
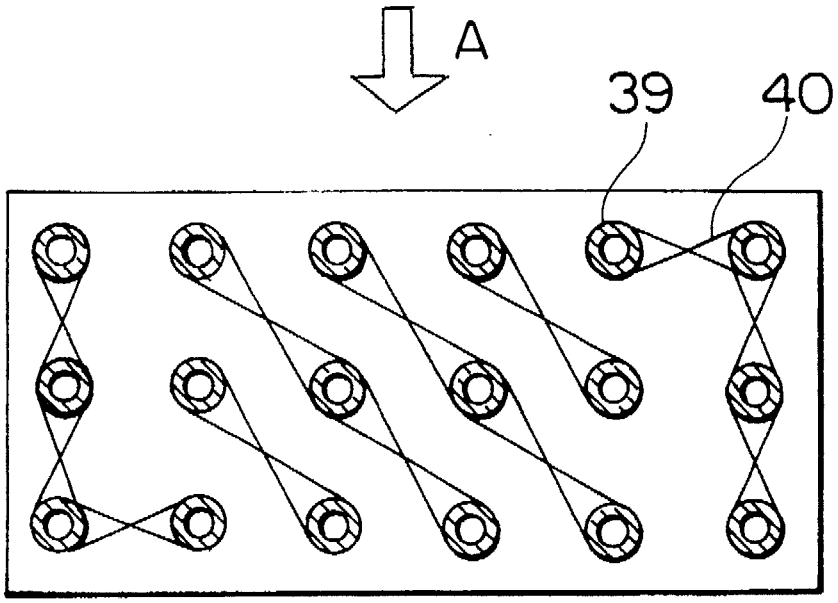
FIG. 24 is a sectional view of a hear exchanger constructed in accordance with a fifteenth embodiment of the present invention as viewed in the direction at a right angle relative to a heat conduction plane thereof.

FIG. 24 is a sectional view of a heat exchanger constructed in accordance with s fifteenth embodiment of the present invention as viewed from the direction at a right angle relative to a heat conduction surface. In the fifteenth embodiment, a plurality of heat conduction pipes 39 are arranged with a predetermined distance in the vertical direction as well as in the transverse direction while exhibiting a rectangular contour. Twisted wires 40 are successively arranged such that they are alternately brought in contact with one side and thus opposite other side of each heat conduction pipe 39 along the heat conduction pipes 39 arranged in the form of a slantwise row at the central part of the heat exchanger. Moreover, twisted wires 40 are successively arranged such that they are alternately brought in contact with one side and the opposite side of each heat conduction pipe 39 along the heat conduction pipes 39 arranged in the form of a vertical row as well as in the form of a transverse row at the positions located in the vicinity of the end part of the heat exchanger. Plural rows of twisted wires 49 are arranged such that twisted wires 40 are crosswise bridged between heat conduction pipes 39 each extending in the longitudinal direction while alternately coming in contact with the opposite sides of each heat conduction pipe.

With this construction, the slantwise arranged twisted wires 40 have a larger intersection angle than those arranged in the vertical direction as well as in the transverse direction, causing an air passage area S to be enlarged. Even though the heat exchanger operates under a condition that moisture in the air is condensed, there hardly arises a malfunction that the surface of the heat exchanger is clogged by dew droplets, resulting in reduction of a quantity of heat exchanging due to reduction of a quantity of air flow being suppressed.

Flowing resistance against the external working fluid A shows a smaller value in the case that the twisted wires 40 are slantwise arranged than in the case that they are arranged in the transverse direction, and moreover, it shows a smaller value in the case that they are arranged in the vertical direction than in the case that they are slantwise arranged. Due to the foregoing fact, pressure loss of the external working fluid A can be minimized by arranging each twisted wire 40 in an arbitrary direction.

What is claimed is:

1. An air conditioner comprising:

a housing having air suction port disposed on at least one of a fore surface and an upper surface, an air blow-off port disposed on a lower part and an air passage formed so as to communicate said air suction port with said air blow-off port;

a filter disposed at a rear stage of said air suction port and disposed across said air passage;

a heat exchanger arranged at the rear stage of said filter and disposed across said air passage; and a blower disposed at the rear stage of said heat exchanger in said air passage;

wherein said heat exchanger has at least one row of heat conduction pipe groups which are disposed across said air passage, each said heat conduction pipe group comprises at least three heat conduction pipes which are arranged in parallel with each other with a predetermined distance between adjacent ones and fine wires each made of a metallic material having excellent heat conductivity spirally wound around each adjacent pair of heat conduction pipes.

2. An air conditioner as claimed in claim 1, wherein a sectional contour of said heat conduction pipe group as viewed in a direction of air flow is bent at plural locations as viewed in said direction of air flow.

3. An air conditioner as claimed in claim 1, wherein said heat conduction pipe group is corrugated in a direction so as to cross the air flow.

4. An air conditioner as claimed in claim 1, wherein a sectional contour of said heat conduction group as viewed in a direction of air flow is formed in a arc-shaped contour.

5. An air conditioner as claimed in claim 1, wherein at least one of a pitch of parallel arrangement of said heat conduction pipes and a pitch of winding of said fine wire is reduced at a location of said heat conduction pipe group corresponding to a high speed part of air flow in said air passage, while at least one of a pitch of parallel arrangement of said heat conduction pipes and a pitch of winding of said fine wire is enlarged at a location of said heat conduction pipe group corresponding to a low speed part of said air flow in said air passage.

6. An air conditioner as claimed in claim 1, wherein plural rows of said heat conduction pipe groups constituting said heat exchanger are arranged as viewed in a direction of air flowing through said air passage, and at least a pitch of parallel arrangement of said heat conduction pipes and a pitch of winding of said fine wire constituting each said heat conduction pipe groups is successively increased from said heat conduction pipe group located at the upstream side row in said air passage toward said heat conduction pipe group located at the downstream side row.

7. An air conditioner as claimed in claim 1, wherein plural rows of said heat conduction pipe groups constituting said heat exchanger are arranged as viewed in a direction of air flowing through said air passage, and a working fluid , which flows in said heat conduction pipe, successively flows from said heat conduction pipe group located at the upstream side row toward said heat conduction pipe group located at the downstream side row with respect to each row.

8. An air conditioner as claimed in claim 1, wherein at least one of said heat conduction pipe and said fine wire exhibits a polygonal sectional contour.

9. An heat conditioner as claimed in claim 1, wherein an axial orientation of each of said heat conduction pipes constituting said heat conduction pipe group is in the vertical direction.

10. An heat conditioner as claimed in claim 9, wherein a sectional contour of said heat conduction pipe group as viewed in a direction of air flow is bent at plural locations as viewed in said direction of air flow.

11. An air conditioner as claimed in claim 9, wherein said heat conduction pipe group is corrugated in a direction to cross the air flow.

12. An air conditioner as claimed in claim 9, wherein a sectional contour of said heat conduction group as viewed in a direction of air flow is formed in a arc-shaped contour.

13. An air conditioner as claimed in claim 9, wherein at least one of a pitch of parallel arrangement of said heat conduction pipes and a pitch of winding of said fine wire is reduced at a location of said heat conduction pipe group corresponding to a high speed part of air flow in said air passage, while at least one of a pitch of parallel arrangement of said heat conduction pipes and a pitch of winding of said fine wire is enlarged at a location of said heat conduction pipe group corresponding to a low speed part of said air flow in said air passage.

14. An air conditioner as claimed in claim 9, wherein plural rows of said heat conduction pipe groups constituting said heat exchanger are arranged as viewed in a direction of air flow through said air passage, and at least a pitch of parallel arrangement of said heat conduction pipes and a pitch of winding of said fine wire constituting each said heat conduction pipe groups is successively increased from said heat conduction pipe group located at the upstream side row in said air passage toward said heat conduction pipe group located at the downstream side row.

15. An air conditioner as claimed in claim 9, wherein plural rows of said heat conduction pipe groups constituting said heat exchanger are arranged as viewed in a direction of air flow through said air passage, and a working fluid , which flows in said heat conduction pipe, successively flows from said heat conduction pipe group located at the upstream side row toward said heat conduction pipe group located at the downstream side row with respect to each row.

16. An air conditioner as claimed in claim 9, wherein at least one of said heat conduction pipe and said fine wire exhibits a polygonal sectional contour.

17. An air conditioner as claimed in claim 1, wherein each of said fine wires comprises a plurality of twisted wires each formed by twisting and winding plural wires each made of a material having excellent heat conductivity.

* * * * *